US011725554B2

(12) United States Patent
Marquardt-Stammberger et al.

(10) Patent No.: US 11,725,554 B2
(45) Date of Patent: Aug. 15, 2023

(54) INSERT ASSEMBLY UNIT FOR A MUFFLER OF AN EXHAUST SYSTEM OF AN INTERNAL COMBUSTION ENGINE

(71) Applicant: Purem GmbH, Neunkirchen (DE)

(72) Inventors: Michael Marquardt-Stammberger, Münsingen (DE); Martin Strähle, Wendlingen am Neckar (DE); Christian Walter, Fellbach (DE)

(73) Assignee: PUREM GMBH, Neunkirchen (DE)

( * ) Notice: Subject to any disclaimer, the term of this patent is extended or adjusted under 35 U.S.C. 154(b) by 22 days.

(21) Appl. No.: 17/224,845

(22) Filed: Apr. 7, 2021

(65) Prior Publication Data

US 2021/0317763 A1 Oct. 14, 2021

(30) Foreign Application Priority Data

Apr. 8, 2020 (DE) ..... 10 2020 109 817.0

(51) Int. Cl.
*F01N 1/08* (2006.01)
*F01N 13/00* (2010.01)
(Continued)

(52) U.S. Cl.
CPC ..... *F01N 1/08* (2013.01); *G10K 11/161* (2013.01); *F01N 2470/02* (2013.01); *F01N 2490/00* (2013.01)

(58) Field of Classification Search
CPC ... F01N 1/08; F01N 1/00; F01N 1/006; F01N 1/02; F01N 1/083; F01N 13/00; F01N 13/08; F01N 13/18; F01N 13/1838; F01N 13/1872; F01N 13/1888; F01N 13/1894; F01N 2470/00; F01N 2470/02; F01N 2470/08; F01N 2470/16; F01N 2470/18;
(Continued)

(56) References Cited

U.S. PATENT DOCUMENTS 5,581,056 A * 12/1996 Bellgardt ..... F01N 13/185 181/282
7,426,980 B2 * 9/2008 Bassani ..... F01N 1/023 181/269
(Continued)

FOREIGN PATENT DOCUMENTS

DE 3807948 C2 * 1/1992 ..... F01N 1/02
DE 102013206769 A1 6/2014
(Continued)

*Primary Examiner* — Edgardo San Martin
(74) *Attorney, Agent, or Firm* — McGlew and Tuttle, P.C.

(57) ABSTRACT

An insert assembly unit for a muffler of an exhaust system of an internal combustion engine includes two walls (12, 14) arranged at spaced locations from one another. Each of the two walls has a circumferential edge area (20, 22) configured for fixing at a circumferential wall of a muffler. An exhaust gas flow unit (26) is arranged between the two walls. The exhaust gas flow unit includes a flow duct area (34) with an exhaust gas outer flow opening (38) to be positioned directed towards an opening in a circumferential wall of a muffler, a first mounting duct area (40) with a first mounting opening (44) for fixing the exhaust gas flow unit at a first wall of the walls, and a second mounting duct area (42) with a second mounting opening (46) for fixing the exhaust gas flow unit at a second wall of the walls.

20 Claims, 3 Drawing Sheets

(51) Int. Cl.
*F01N 13/18* (2010.01)
*G10K 11/16* (2006.01)

(58) Field of Classification Search
CPC ..... F01N 2490/00; F01N 2490/08; G10K 11/161
See application file for complete search history.

(56) References Cited

U.S. PATENT DOCUMENTS 8,051,949 B2 * 11/2011 Henke ..... F01N 1/08 181/251
8,205,713 B2 * 6/2012 Gorke ..... F01N 13/1838 181/227
8,205,716 B2 * 6/2012 Wirth ..... F01N 13/185 181/269
8,307,944 B2 * 11/2012 Reinheimer ..... F01N 13/1838 181/269
8,684,131 B1 * 4/2014 Park ..... F01N 1/04 181/239
9,010,486 B2 * 4/2015 Andre ..... F01N 13/1888 181/227
9,133,753 B2 * 9/2015 Vollmer ..... F01N 1/003
9,816,413 B2 * 11/2017 Schmidt ..... F01N 13/185
10,167,756 B2 * 1/2019 Marquardt-Stammberger ..... G10K 11/172
10,208,639 B2 * 2/2019 Lee ..... G10K 11/172
10,267,207 B2 * 4/2019 Krause ..... F01N 13/1844
10,787,951 B2 * 9/2020 Dougherty ..... F01N 1/084
11,199,116 B2 * 12/2021 Ostromecki ..... F01N 1/003
11,248,513 B2 * 2/2022 Zdravkov ..... F01N 13/1894
11,365,658 B2 * 6/2022 Ostromecki ..... F01N 1/003
2010/0116586 A1 5/2010 Andre et al.
2019/0178124 A1 6/2019 Ostromecki et al.
2019/0301323 A1 10/2019 Ahn

FOREIGN PATENT DOCUMENTS

DE 102014110098 A1 1/2016
DE 102018124198 A1 4/2019
JP 2010255520 A 11/2010
JP 2013238160 A 11/2013
KR 200171218 Y1 * 4/2000 ..... F01N 1/00

* cited by examiner

INSERT ASSEMBLY UNIT FOR A MUFFLER OF AN EXHAUST SYSTEM OF AN INTERNAL COMBUSTION ENGINE

CROSS REFERENCE TO RELATED APPLICATIONS

This application claims the benefit of priority under 35 U.S.C. § 119 of German Application 10 2020 109 817.0, filed Apr. 8, 2020, the entire contents of which are incorporated herein by reference.

TECHNICAL FIELD

The present invention pertains to an insert assembly unit for a muffler of an exhaust system of an internal combustion engine.

TECHNICAL BACKGROUND

It is known to provide different components guiding the exhaust gas stream in the muffler interior, for example, partitions separating chambers from one another or pipes connecting such chambers to one another, in order to obtain a defined flow guiding of the exhaust gas introduced into mufflers of exhaust systems.

SUMMARY

An object of the present invention is to provide an insert assembly unit having a structurally simple configuration for a muffler of an exhaust system of an internal combustion engine.

This object is accomplished according to the present invention by means of an insert assembly unit for a muffler of an exhaust system of an internal combustion engine, comprising two walls arranged at spaced locations from one another, wherein each of the two walls has a circumferential edge area configured for fixing at a circumferential wall of a muffler, and an exhaust gas flow unit arranged between the two walls, wherein the exhaust gas flow unit comprises:

- a flow duct area with an exhaust gas outer flow opening to be positioned directed towards an opening in a circumferential wall of a muffler,
- a first mounting duct area with a first mounting opening for fixing the exhaust gas flow unit at a first wall of the walls, and
- a second mounting duct area with a second mounting opening for fixing the exhaust gas flow unit at a second wall of the walls.

The insert assembly unit configured according to the present invention may be assembled into a unit by the provision of the two mounting duct areas in a simple manner with the walls accommodating the exhaust gas flow unit between them and may be integrated as such into a muffler.

For a stable mounting interaction with the two walls, a duct longitudinal axis of the first mounting duct area may essentially correspond to a duct longitudinal axis of the second mounting duct area. Furthermore, provisions may be made for the exhaust gas flow unit to be open in directions opposed to one another at the first mounting opening and at the second mounting opening.

For a stable connection with positive-locking action of the exhaust gas flow unit to the walls, a first mounting bulge meshing with the first mounting duct area in the area of the first mounting opening may be provided at the first wall, and a second mounting bulge meshing with the second mounting duct area in the area of the second mounting opening may be provided at the second wall.

In order to avoid a passage of exhaust gas from a chamber formed between the two walls, in which chamber the exhaust gas flow unit is also arranged, to at least one adjacent chamber in the area of the mounting openings, it is proposed that the first mounting bulge essentially close the first mounting duct area against the passage of exhaust gas in the area of the first mounting opening, or/and that the second mounting bulge essentially close the second mounting duct area against the passage of exhaust gas in the area of the second mounting opening. It should be pointed out in this connection that this does not preclude that the exhaust gas flow unit is, in principle, open in the area of the mounting duct areas in order to be able to accommodate the mounting bulges then essentially closing the mounting openings.

When a duct longitudinal axis of the flow duct area is arranged essentially at right angles to the duct longitudinal axis of the first mounting duct area or/and to the duct longitudinal axis of the second mounting duct area, an essentially T-shaped or Y-shaped structure of the exhaust gas flow unit is obtained, which structure can interact in respective end areas of the structure with the walls and with a circumferential wall of the muffler for a stable hold.

In order to make possible a passage of exhaust gas through the exhaust gas flow unit, the flow duct area, the first mounting duct area and the second mounting duct area may be open towards an exhaust gas flow unit central volume.

For a configuration that can be embodied in a structurally simple manner, it is proposed that the exhaust gas flow unit comprise an exhaust gas flow unit housing with a first housing shell and with a second housing shell connected to the first housing shell in fastening edge areas.

In order to be able to embody a flow connection via the exhaust gas flow unit, a plurality of exhaust gas inner flow openings, which are open towards the exhaust gas flow unit central volume, may be provided in the first housing shell or/and in the second housing shell.

The stable integration of the exhaust gas flow unit in a muffler can be further supported by at least one mounting projection, which meshes with a meshing opening of one of the walls, being provided at the exhaust gas flow unit housing. Provisions may especially be made for mounting projections, each of which extends towards one of the walls, to be provided at the first housing shell or at the second housing shell.

A configuration which can be embodied in a simple and cost-effective manner and yet is thermally stable and resistant to exhaust gases can be achieved by the walls and the exhaust gas flow unit being shaped sheet metal parts.

Further, the flow of exhaust gas from and towards the chamber formed between the two walls can be achieved by a plurality of exhaust gas inner flow openings being provided in at least one wall, preferably in both walls.

The present invention further pertains to a muffler for an exhaust system of an internal combustion engine, comprising a circumferential wall enclosing a muffler interior and an insert assembly unit having the configuration according to the present invention arranged in the muffler interior.

In this case, the exhaust gas outer flow opening may be directed towards an opening formed in the circumferential wall, which can be achieved, for example, by the flow duct area traversing the opening in the circumferential wall.

At least one wall, preferably each of the two walls, may be a partition separating chambers formed in the muffler interior from one another.

The present invention will be described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
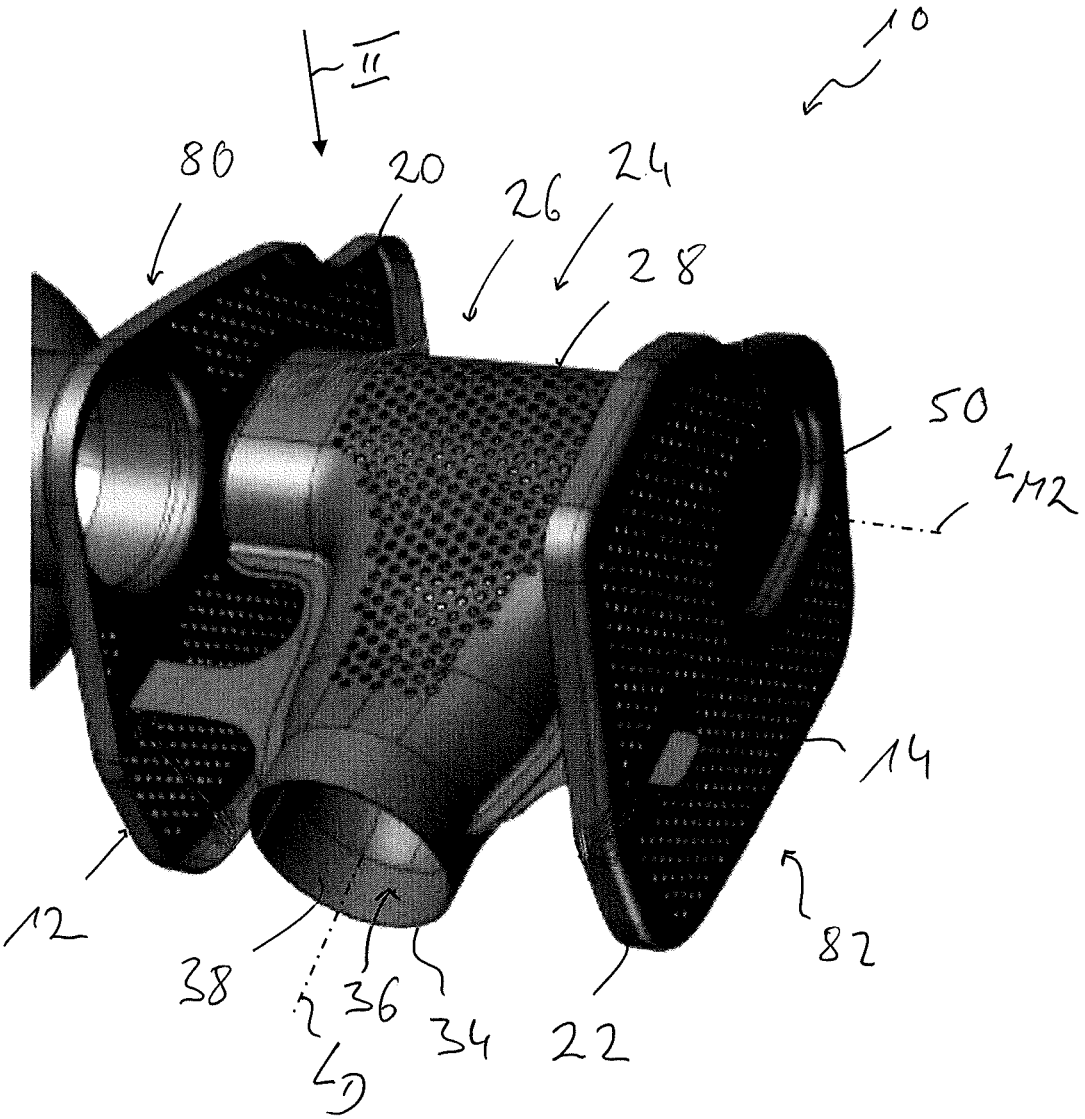
FIG. 1 is a perspective view of an insert assembly unit of a muffler of an exhaust system for an internal combustion engine.
Figure 2:
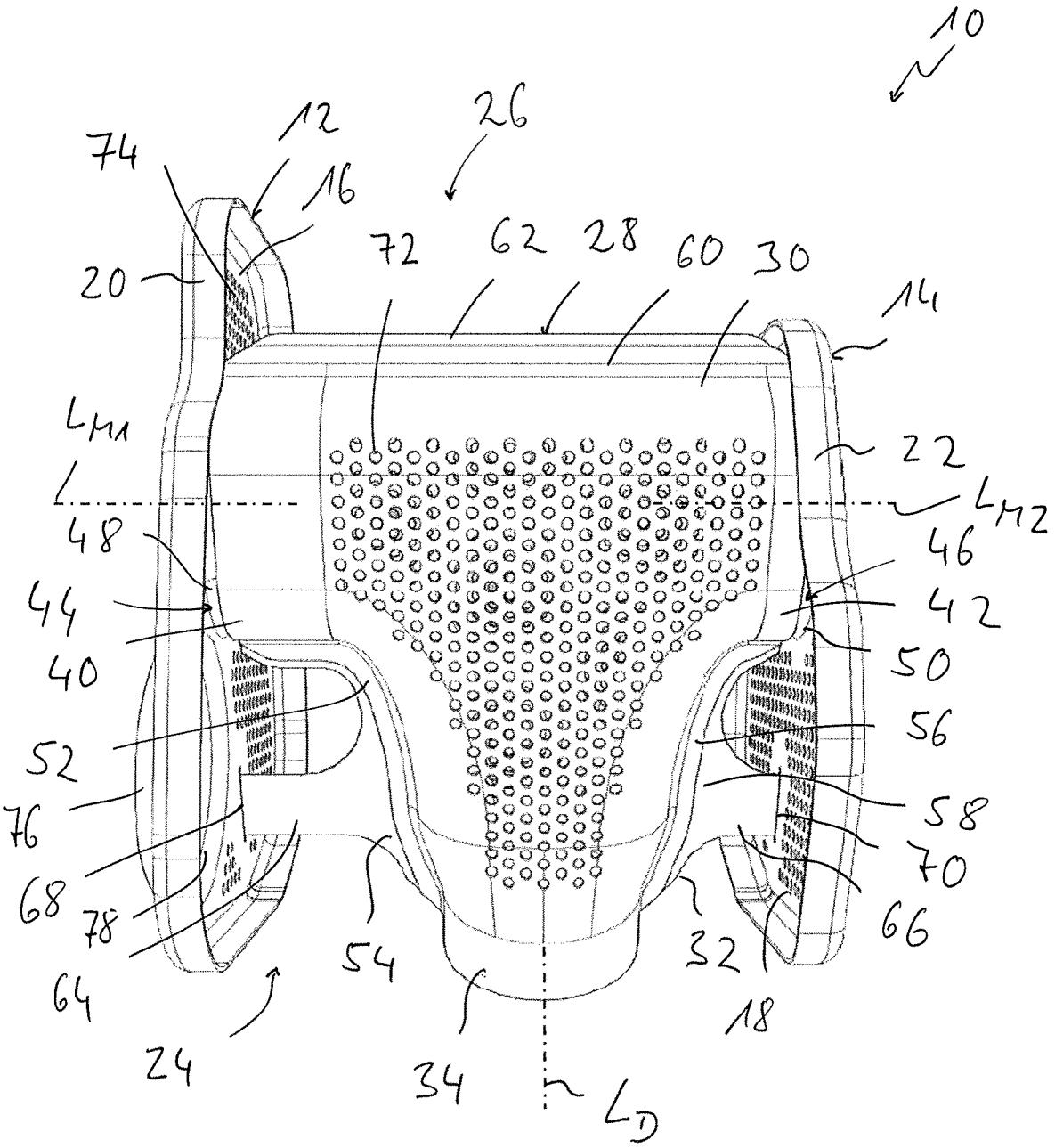
FIG. 2 is a top view of the insert unit in viewing direction II in FIG. 1.
Figure 3:
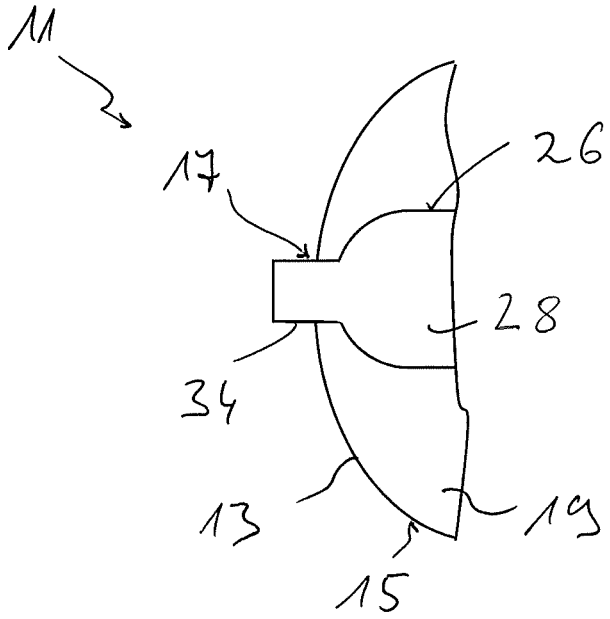
FIG. 3 is a schematic view showing a circumferential wall of a muffler of an exhaust gas flow unit of an insert assembly unit from FIGS. 1 and 2.

Referring to the drawings, FIGS. 1 and 2 show an insert assembly unit, which is generally designated by 10, for a muffler 11 of an exhaust system of an internal combustion engine. The insert assembly unit 10 comprises two walls 12, 14 configured as shaped sheet metal parts. Each of the walls 12, 14 has an approximately plate-shaped wall body 16, 18 and on the outer circumference thereof a circumferential edge area 20, 22 provided for fixing at a circumferential wall 13 of a muffler housing 15 (FIG. 3). The walls 12, 14, which may be arranged, for example, as partitions in the muffler 11, preferably adjoin the inner surface of the circumferential wall 13 over the entire circumference with these circumferential edge areas 20, 22.

An exhaust gas flow unit generally designated by 26 is arranged in a chamber 24 formed between the two walls 12, 14. The exhaust gas flow unit 26 has an exhaust gas flow unit housing 28, which is configured with two housing shells 30, 32 complementary to one another. Just as the walls 12, 14, the two housing shells 30, 32 are configured as a shaped sheet metal part or as shaped sheet metal parts.

The exhaust gas flow unit 26 has a flow duct area 34, in which a central volume 36 formed in the interior of the exhaust gas flow unit 26 is open via an exhaust gas outer flow opening 38. The flow duct area 34 may be a, for example, essentially cylindrical end area of the exhaust gas flow unit housing 28, which extends in at least some areas along a duct longitudinal axis LD of the flow duct area 34.

The exhaust gas outer flow opening 38 formed in the flow duct area 34 is arranged in the muffler 11 such that it is directed towards an opening 17 provided in the circumferential wall 13, so that exhaust gas can be introduced into the muffler 11 or be discharged from same via the exhaust gas outer flow opening 38. To this end, for example, the flow duct area 34 may traverse the opening 17 provided in the circumferential wall 13 and may be connected gastightly, for example, by welding to the circumferential wall 13 in this area.

The exhaust gas flow unit 26 further comprises a first mounting duct area 40 as well as a second mounting duct area 42. With the first mounting duct area 40, the exhaust gas flow unit housing 28 extends towards the first wall 12. With the second mounting duct area 42, the exhaust gas flow unit housing 28 extends towards the second wall 14. Each of the mounting duct areas, 40, 42 that extend away from the central volume 36 essentially in directions opposed to one another is elongated in at least some areas along a respective duct longitudinal axis LM1 and LM2 and may be provided by an approximately cylindrical section of the exhaust gas flow unit housing 28. In principle, the exhaust gas flow unit housing 28 is open in the area of each mounting duct area 40, 42 via a respective first mounting opening 44 or second mounting opening 46. In association with each of these mounting openings 44, 46, corresponding mounting bulges 48, 50 are formed at the two walls 12, 14. The mounting bulges protrude from the respective plate-shaped wall body 16, 18 towards the respective other wall 12, 14, so that they can be positioned such that they mesh with a respective mounting duct area 40, 42 in the area of the respective first mounting opening 44 or second mounting opening 46 provided there. The outer circumferential contour of the mounting bulges 48, 50 is adapted to the inner circumferential contour of the mounting duct areas 40, 42, so that the mounting bulges meshing in the area of the first mounting opening 44 and of the second mounting opening 46 are held by positive locking therein in a stable manner and obliquely to the respective duct longitudinal axis LM1, LM2. Since preferably no openings traversing the walls 12, 14 are formed in the mounting bulges 48, 50, the two mounting duct areas 40, 42 are essentially closed against the passage of exhaust gas through the mounting bulges 48, 50.

The two housing shells 30, 32 are permanently connected in substance to one another, for example, by welding in two edge areas 52, 54 or 56, 58, which protrude each outwards from the flow duct area 34 to the first mounting duct area 40 or to the second mounting duct area 42 and adjoin one another. The two housing shells 30, 32 may also be connected in substance to one another in an area between the two mounting openings 44, 46 at wall sections 60, 62 of the two housing shells 30, 32, which wall sections 60, 62 face away from the flow duct area 34. In an alternative embodiment, these two housing shells 30, 32 may be connected integrally to one another in the area of the wall sections 60, 62, i.e., be provided by a single shaped sheet metal part, which is bent in a transition area between the two wall sections 60, 62 after carrying out the shaping process and is brought into the T or Y shape that can be seen in the figures.

Mounting projections 64, 66, which extend towards the respective opposing wall 12 or 14, are provided, for example, as extended sections of the edge areas 54 or 58 at the housing shell 32 shown at the bottom in FIGS. 1 and 2. Slot-like meshing openings 68, 70, which are adapted to the circumferential contour of the mounting projections 64, 66 and with which the mounting projections 64, 66 mesh, for example, such that they protrude on the side of the respective plate-shaped wall body 16, 18, which side faces away from the exhaust gas flow unit 26, are provided in the walls 12, 14.

The two mounting projections 64, 66 may be accommodated in the meshing openings 68, 70 accommodating same, for example, with little clearance or with press fit, so that no additional actions are necessary to achieve a fixed connection of the walls 12, 14 to the exhaust gas flow unit 26. The mounting bulges 48, 50 may also be dimensioned such that they are inserted into the mounting duct areas 40, 42 with press fit. As an alternative or in addition, a fixed connection may also be guaranteed by the exhaust gas flow unit 26 being permanently connected to the walls 12, 14 by connection in substance, for example, welding, in the area of the mounting projections 64, 66 or/and in the area of the mounting duct areas 40, 42.

In order to make possible the entry and discharge of exhaust gas into the chamber 24 and out of the chamber 24, exhaust gas inner flow openings 72 are provided at the exhaust gas flow unit housing 28. Such inner flow openings 72 may be provided in one or in both housing shells 30, 32 in the exhaust gas flow unit housing 28 and thus provide a flow connection between the central volume 36 in the interior of the exhaust gas flow unit 26 and the inner volume of the chamber 24. Likewise, a plurality of exhaust gas inner flow openings 74, which establish a flow connection between the chamber 24 between the two walls 12, 14 and chambers 80, 82 each adjoining same on both sides in a muffler interior 19, are provided in the two walls 12, 14 each in the area of the plate-shaped wall bodies 16, 18. Further, as this can be seen, for example, on the basis of the wall 12, the chamber 24 may be open via at least one of the walls 12, 14, towards an adjacent chamber or towards another chamber in the muffler interior 19 by means of a connecting pipe 76 and by means of an exhaust gas flow opening 78 formed in the wall 12 in the example being shown.

The inner flow openings 72, 74 are preferably arranged in a regular opening pattern at the exhaust gas flow unit housing 28 and at the walls 12, 14 and provide each a perforation distributed over a large area, which perforation distribution guarantees an approximately uniform passage of exhaust gas distributed over a larger surface.

In the exhaust gas flow unit being shown in the figures, the two duct longitudinal axes LM1, LM2 of the mounting duct areas 40, 42 are arranged such that they are located coaxially to one another, i.e., they continue one another, so that the two mounting duct areas 40, 42 and the mounting openings 44, 46 are also positioned essentially congruently. The duct longitudinal axis LD of the flow duct area 34 is preferably arranged such that it is located approximately at right angles to the two duct longitudinal axes LM1, LM2 of the mounting duct areas 40, 42, even though these axes do not necessarily have to lie in a common plane. In such an embodiment, the exhaust gas flow unit 26 may be configured as being essentially mirror symmetrical to a plane of symmetry containing the longitudinal axis LD of the flow duct area 34. The two mounting duct areas 40, 42 may also, in principle, have different cross-sectional dimensions or different cross-sectional shapes, or/and they may be offset in relation to one another obliquely to their respective longitudinal axes.

The mounting projections 64, 66 are preferably provided at the same housing shell 32, which leads to an especially stable configuration. As an alternative, these two mounting projections 64, 66 could also be arranged at different housing shells 30, 32, and a plurality of mounting projections, one or some of which may be provided in association with one of the two housing shells 30, 32, could also be provided at least in association with one of the two walls 12, 14, while the other mounting projections may be provided at the other of the two housing shells 30, 32.

While specific embodiments of the invention have been shown and described in detail to illustrate the application of the principles of the invention, it will be understood that the invention may be embodied otherwise without departing from such principles.

What is claimed is:

1. An insert assembly unit for a muffler of an exhaust system of an internal combustion engine, the insert assembly comprising:

a first wall with a circumferential edge area configured for fixing at a circumferential wall of a muffler and with a first mounting bulge;

a second wall arranged at a spaced location from the first wall, wherein the second wall has a circumferential edge area configured for fixing at a circumferential wall of a muffler and has a second mounting bulge; and an exhaust gas flow unit arranged between the two walls, wherein the exhaust gas flow unit comprises:

a flow duct area with an exhaust gas outer flow opening to be positioned directed towards an opening in a circumferential wall of the muffler;

a first mounting duct area with a first mounting opening for fixing the exhaust gas flow unit at the first wall, the first mounting bulge of the first wall engaging into the first mounting opening of the first mounting duct area; and a second mounting duct area with a second mounting opening for fixing the exhaust gas flow unit at the second wall, the second mounting bulge of the second wall engaging into the second mounting opening of the second mounting duct area.

2. The insert assembly unit in accordance with claim 1, wherein a duct longitudinal axis of the first mounting duct area essentially corresponds to a duct longitudinal axis of the second mounting duct area.

3. The insert assembly unit in accordance with claim 2, wherein:

the exhaust gas flow unit is open in directions opposed to one another at the first mounting opening; and the exhaust gas flow unit is open in directions opposed to one another at the second mounting opening.

4. The insert assembly unit in accordance with claim 1, wherein:

the first mounting bulge essentially closes the first mounting duct area against the passage of exhaust gas in the area of the first mounting opening; or the second mounting bulge essentially closes the second mounting duct area against the passage of exhaust gas in the area of the second mounting opening; or the first mounting bulge essentially closes the first mounting duct area against the passage of exhaust gas in the area of the first mounting opening and the second mounting bulge essentially closes the second mounting duct area against the passage of exhaust gas in the area of the second mounting opening.

5. The insert assembly unit in accordance with claim 2, wherein:

a duct longitudinal axis of the flow duct area is arranged essentially at right angles to the duct longitudinal axis of the first mounting duct area; or a duct longitudinal axis of the flow duct area is arranged essentially at right angles to the duct longitudinal axis of the second mounting duct area; or a duct longitudinal axis of the flow duct area is arranged essentially at right angles to the duct longitudinal axis of the first mounting duct area and the duct longitudinal axis of the flow duct area is arranged essentially at right angles to the duct longitudinal axis of the second mounting duct area.

6. The insert assembly unit in accordance with claim 1, wherein:

the exhaust gas flow unit has an exhaust gas flow unit central volume;

the flow duct area is open towards the exhaust gas flow unit central volume;

the first mounting duct area is open towards the exhaust gas flow unit central volume; and the second mounting duct area is open towards the exhaust gas flow unit central volume.

7. The insert assembly unit in accordance with claim 6, wherein a plurality of exhaust gas inner flow openings, which are open towards the exhaust gas flow unit central volume, are provided in the exhaust gas flow unit.

8. The insert assembly unit in accordance with claim 6, wherein:

the exhaust gas flow unit has at least one mounting projection;

at least one of the first wall and the second wall has a meshing opening; and the at least one mounting projection meshes with the meshing opening.

9. The insert assembly unit in accordance with claim 1, wherein:

the exhaust gas flow unit comprises an exhaust gas flow unit housing with a first housing shell and with a second housing shell; and the first housing shell is connected to the first housing shell in fastening edge areas.

10. The insert assembly unit in accordance with claim 9, wherein:

the exhaust gas flow unit housing has at least one mounting projection;

at least one of the first wall and the second wall has a meshing opening; and the at least one mounting projection meshes with the meshing opening.

11. The insert assembly unit in accordance with claim 9, wherein:

the exhaust gas flow unit housing has a first shell mounting projection at the first housing shell;

the exhaust gas flow unit housing has a second shell mounting projection at the second housing shell;

the first wall has a first wall meshing opening;

the first shell mounting projection extends towards the first wall and meshes with the first wall meshing opening;

the second wall has a second wall meshing opening; and the second shell mounting projection extends towards the second wall and meshes with the second wall meshing opening.

12. The insert assembly unit in accordance with claim 9, wherein the exhaust gas flow unit has an exhaust gas flow unit central volume, wherein:

a plurality of exhaust gas inner flow openings, which are open towards the exhaust gas flow unit central volume, are provided in the first housing shell; or a plurality of exhaust gas inner flow openings, which are open towards the exhaust gas flow unit central volume, are provided in the second housing shell; or a plurality of first housing shell exhaust gas inner flow openings, which are open towards the exhaust gas flow unit central volume, are provided in the first housing shell and a plurality of second housing shell exhaust gas inner flow openings, which are open towards the exhaust gas flow unit central volume, are provided in the second housing shell.

13. The insert assembly unit in accordance with claim 1, wherein:

the first wall, the second wall and the exhaust gas flow unit comprise shaped sheet metal parts; or a plurality of exhaust gas inner flow openings are provided in at least one of the first wall and the second wall; or the first wall, the second wall and the exhaust gas flow unit comprise shaped sheet metal parts and a plurality of exhaust gas inner flow openings are provided in at least one of the first wall and the second wall.

14. A muffler for an exhaust system of an internal combustion engine, the muffler comprising:

a circumferential wall enclosing a muffler interior; and an insert assembly comprising:

a first wall with a circumferential edge area configured for fixing at the circumferential wall and with a first mounting bulge;

a second wall arranged at a spaced location from the first wall, wherein the second wall has a circumferential edge area configured for fixing at the circumferential wall and has a second mounting bulge; and an exhaust gas flow unit arranged between the first wall and the second wall, wherein the exhaust gas flow unit comprises:

a flow duct area with an exhaust gas outer flow opening to be positioned directed towards an opening in the circumferential wall;

a first mounting duct area with a first mounting opening, for fixing the exhaust gas flow unit at the first wall, the first mounting bulge of the first wall engaging into the first mounting opening of the first mounting duct area; and a second mounting duct area with a second mounting opening, for fixing the exhaust gas flow unit at the second wall, the second mounting bulge of the second wall engaging into the second mounting opening of the second mounting duct area, wherein the insert assembly unit is arranged in the muffler interior.

15. The muffler in accordance with claim 14, wherein:

the exhaust gas outer flow opening is directed towards an opening in the circumferential wall; or the flow duct area traverses the opening in the circumferential wall; or the exhaust gas outer flow opening is directed towards an opening in the circumferential wall and the flow duct area traverses the opening in the circumferential wall.

16. The muffler in accordance with claim 14, wherein at least one of the first wall and the second wall is a partition, separating chambers formed in the muffler interior from one another.

17. The muffler in accordance with claim 14, wherein:

the exhaust gas flow unit has an exhaust gas flow unit central volume;

the flow duct area is open towards the exhaust gas flow unit central volume;

the first mounting duct area is open towards the exhaust gas flow unit central volume; and the second mounting duct area is open towards the exhaust gas flow unit central volume.

18. The muffler in accordance with claim 14, wherein:

the exhaust gas flow unit comprises an exhaust gas flow unit housing with a first housing shell and with a second housing shell; and the first housing shell is connected to the first housing shell in fastening edge areas.

19. The muffler in accordance with claim 18, wherein:

the exhaust gas flow unit housing has a first shell mounting projection at the first housing shell;

the exhaust gas flow unit housing has a second shell mounting projection at the second housing shell;

the first wall has a first wall meshing opening;

the first shell mounting projection extends towards the first wall and meshes with the first wall meshing opening;

the second wall has a second wall meshing opening; and the second shell mounting projection extends towards the second wall and meshes with the second wall meshing opening.

20. An insert assembly unit for a muffler of an exhaust system of an internal combustion engine, the insert assembly comprising:

a first wall comprising a circumferential edge area configured for fixing at a circumferential wall of a muffler, the first wall further comprising a first mounting bulge;

a second wall arranged at spaced location from the first wall, wherein the second wall comprises a circumferential edge area configured for fixing at a circumferential wall of a muffler, the second wall further comprising a second mounting bulge; and an exhaust gas flow unit arranged between the two walls, wherein the exhaust gas flow unit comprises a housing, the housing comprising a first housing portion, a second housing portion and a third housing portion, the third housing portion comprising a flow duct area, the flow duct area comprising an exhaust gas outer flow opening to be positioned directed towards an opening in a circumferential wall of the muffler, the first housing portion comprising a first mounting duct area having a first housing portion inner surface defining a first mounting opening for fixing the exhaust gas flow unit at the first wall, at least a portion of the first mounting bulge being arranged in the first mounting opening of the first mounting duct area, the portion of the first mounting bulge comprising a first mounting bulge outer surface, the first mounting bulge outer surface engaging the first housing portion inner surface, the second housing portion comprising a second mounting duct area having a second housing portion inner surface defining a second mounting opening for fixing the exhaust gas flow unit at the second wall, at least a portion of the second mounting bulge being arranged in the second mounting opening of the second mounting duct area, the portion of the second mounting bulge comprising a second mounting bulge outer surface, the second mounting bulge outer surface engaging the second housing portion inner surface.

* * * * *